United States Patent [19]

Shaffer

[11] Patent Number: 4,717,169

[45] Date of Patent: Jan. 5, 1988

[54] CONVERTIBLE BED AND WHEELCHAIR UNIT

[75] Inventor: Willis G. Shaffer, Westminster, Colo.

[73] Assignee: Michael J. Salazar, Westminster, Colo. ; a part interest

[21] Appl. No.: 861,407

[22] Filed: May 9, 1986

[51] Int. Cl.[4] ..... A47C 13/00; A61G 5/00

[52] U.S. Cl. ..... 280/648; 5/68; 280/242 WC; 280/657; 297/355; 297/DIG. 4

[58] Field of Search ..... 280/30, 242 WC, 638, 280/640, 643, 648, 657, 47.41, 648; 297/355, 359, DIG. 4, 436, 377, 80, 84; 5/66, 67, 68, 69, 81 R, 81 B

[56] References Cited

U.S. PATENT DOCUMENTS

| | | | |
|---|---|---|---|
| 1,984,311 | 12/1934 | Lamar | 280/30 |
| 2,377,649 | 6/1945 | Quinney | 297/377 |
| 2,556,591 | 6/1951 | Loxley | 5/67 |
| 2,587,068 | 2/1952 | Sanders | 5/81 R |
| 2,694,437 | 11/1954 | Glaser | 280/657 |
| 3,038,174 | 6/1962 | Brown | 5/68 |
| 3,094,713 | 6/1963 | Wise | 5/67 |
| 3,284,126 | 11/1966 | Piazza | 5/67 |
| 4,105,242 | 8/1978 | Terbeek | 280/640 |
| 4,125,269 | 11/1978 | Kiel | 280/30 |
| 4,453,732 | 6/1984 | Assanah | 280/648 |

FOREIGN PATENT DOCUMENTS

| | | | |
|---|---|---|---|
| 7901599 | 9/1980 | Netherlands | 297/DIG. 4 |

*Primary Examiner*—John J. Love
*Assistant Examiner*—Everett G. Diederiks, Jr.
*Attorney, Agent, or Firm*—Fleit, Jacobson, Cohn & Price

[57] ABSTRACT

A wheeled structure is readily convertible as between a full-sized single bed and a wheelchair. The structure comprises three pivotally interconnected sections, namely a foot section, a seat section and a head section. In the bed forming position of the unit, the three sections are disposed horizontally to form a continuous mattress support surface. To convert the unit to the wheelchair forming position, the head section is swung upwardly and secured in position by latch members on the back ends of pivotal armrests. The foot section is swung down into vertical orientation and secured to the seat section by bracing rods. The device is simple to convert as between the wheelchair and bed forming positions.

12 Claims, 6 Drawing Figures

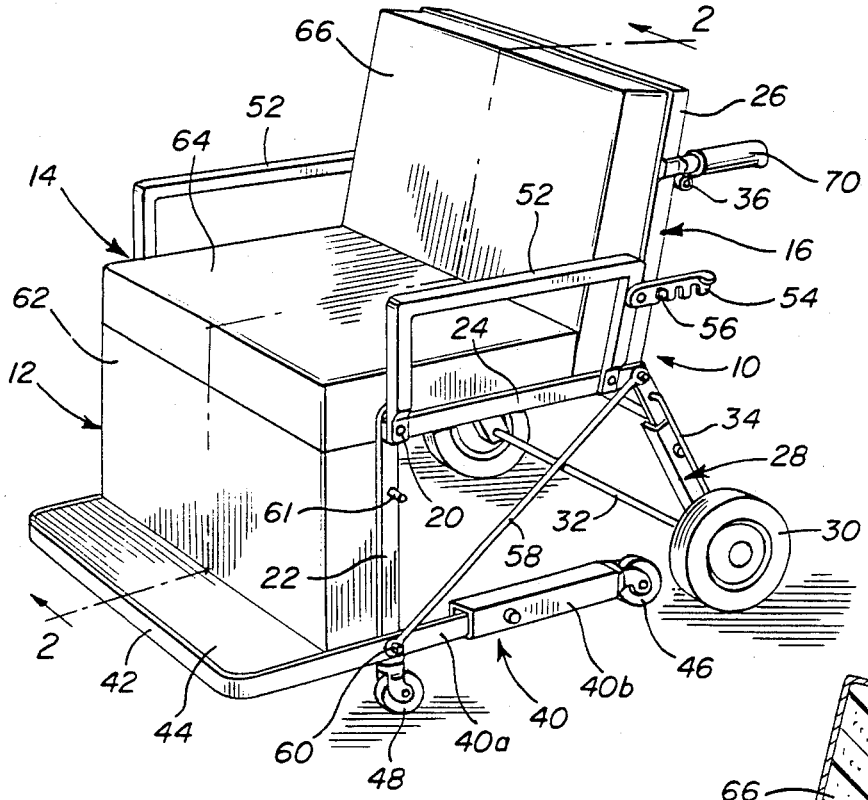
FIG. 1
FIG. 2
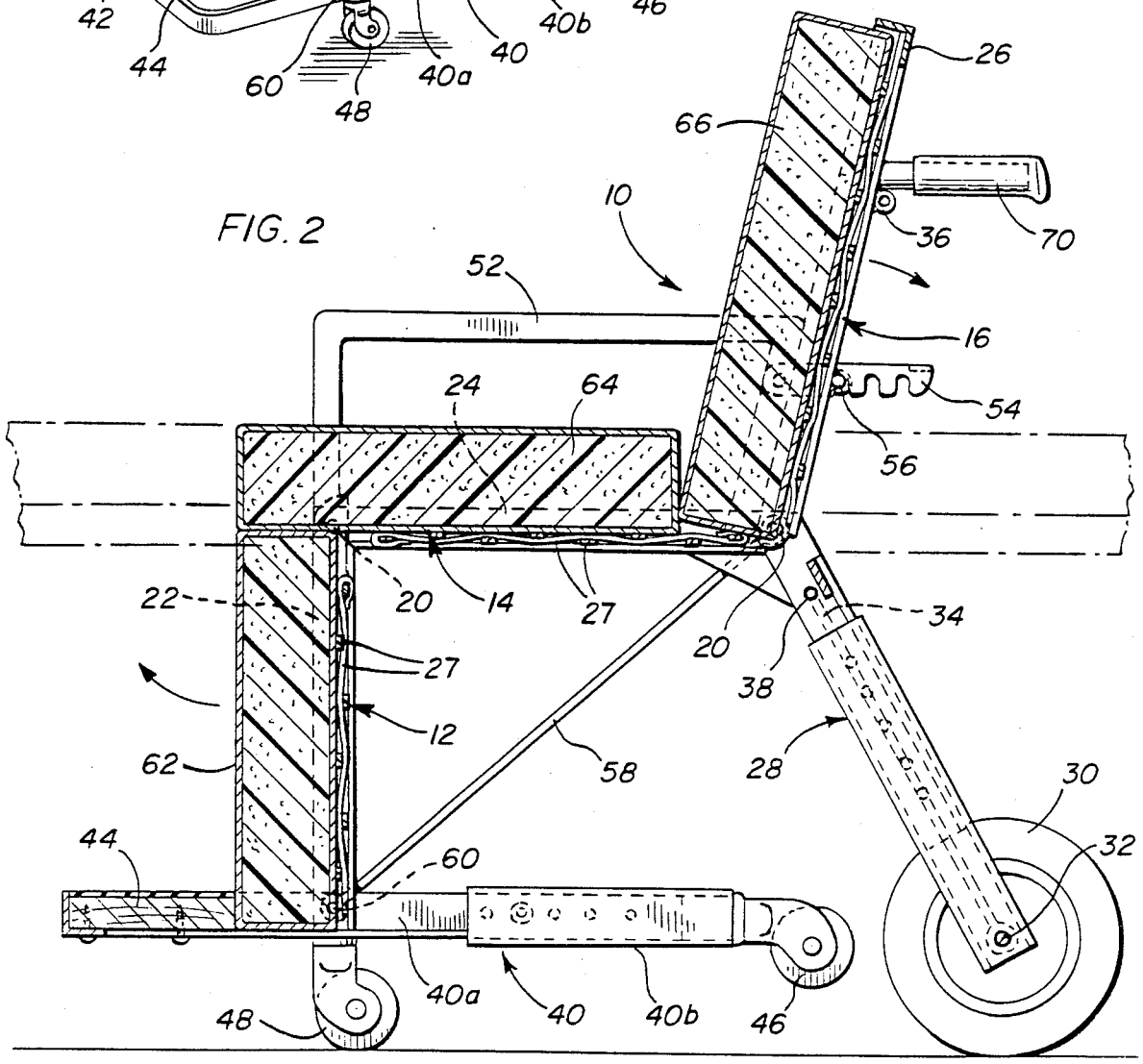

CONVERTIBLE BED AND WHEELCHAIR UNIT

BACKGROUND OF THE INVENTION

This invention relates to a wheeled structure for domestic or institutional use, primarily for invalids, patients, handicapped or otherwise immobilized persons, and which is convertible as between a full-sized bed and a mobile wheelchair.

In medical institutions such as hospitals or clinics, there is frequently a need, for example, to transport a patient on a wheelchair, which involves moving the patient to and from his or her bed onto the wheelchair and back. A convertible bed/wheelchair unit in accordance with the invention, which can readily be converted as between its respective bed and wheelchair configurations is particularly useful in this and similar applications, since it involves minimum disturbance to the patient. It is also useful in domestic applications where, for example, an invalid requires assistance in moving about the home, while space and/or economic considerations make the provision of a single bed/-wheelchair unit an advantage as compared to a separate bed and wheelchair.

Applicant is aware of the following prior U.S. patents relating to convertible structures and the like, namely, U.S. Pat. Nos. 639,554, 641,988, 813,799, 1,975,664, 3,138,805, 4,119,342 and 4,285,541. None of these patents, however, discloses a convertible unit having the features of the present invention.

SUMMARY OF THE INVENTION

It is an object of the invention to provide a convertible bed and wheelchair unit which provides in its bed mode, the general comfort and support of a conventional full-sized single bed, but which can readily and simply be converted into its wheelchair mode and back with minimum disturbance to the occupant.

A convertible bed/wheelchair unit in accordance with the invention, comprises a three-part pivotally interconnected frame including a first part constituting a foot portion of the unit, a second part constituting a central or seat portion of the unit, and a third part constituting a head portion of the unit, the foot and head portions being pivotally interconnected to opposite ends of the central portion about respective transverse axes for respective pivotal movements as between bed and wheelchair forming modes of the unit. In the bed forming mode, the three frame portions are disposed in horizontal alignment to provide a mattress support surface, the central portion having legs at its back end forming rear legs for the bed, and the foot portion having legs at its forward end beneath a footboard, and which constitute front legs of the bed. The mattress support surface is covered by separate mattress segments or cushions conforming in area substantially to the respective frame portions. In the bed forming mode, the head portion may be supported by releasable bracing rods on opposite sides of the unit connected between the lower ends of the back legs and the underside of the framework of the head portion. The back legs have wheels and the front legs have casters. Wheel and caster locks of known form may be provided for use therewith when the unit is in the bed forming mode.

To convert the unit to the wheelchair forming mode, the bracing rods between the head portion and back legs are released, and the head portion is pivoted upwardly into a vertically inclined position. The central portion of the unit is provided with pivotal armrests which swing down below the frame in the bed forming mode, and these are now swung upwardly into operative position and latched at their back ends onto suitable keepers on the head portion, so as to support and retain the head portion in elevated position. While suitably supporting the front end of the central portion, the foot portion is swung downwardly so that the front legs swing beneath the central portion, which forms the seat of the wheelchair. Further, the frame of the foot portion (which was horizontal in the bed forming made) has projections beyond the footboard with further casters, possibly detachable, which are brought into ground engagement when the foot portion is swung down into vertical alignment with the footboard projecting horizontally. The unit has additional releasable bracing rods which in the wheelchair mode connect between the lower end of the foot portion and the back end of the central portion to support the unit. The cushions are adjusted longitudinally to an extent as between the respective modes of the unit. The cushions or mattress segments may be of the foam type for added comfort. The unit may be provided with operator handles for pushing same in the wheelchair mode, and with other suitable fittings.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a convertible bed/-wheelchair unit in accordance with the invention shown in the wheelchair forming mode.

FIG. 2 is an enlarged sectional view on line 2—2 of FIG. 1.

DESCRIPTION OF THE PREFERRED EMBODIMENT

Figure 3:
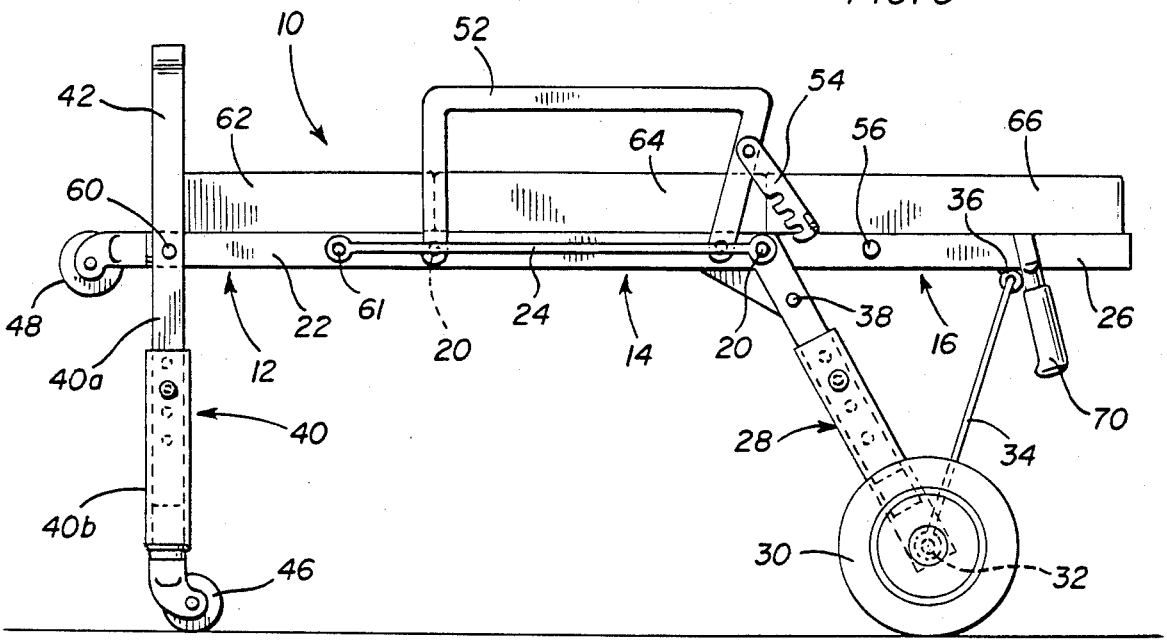
FIG. 3 is a side elevational view of the unit in the bed forming mode.
Figure 4:
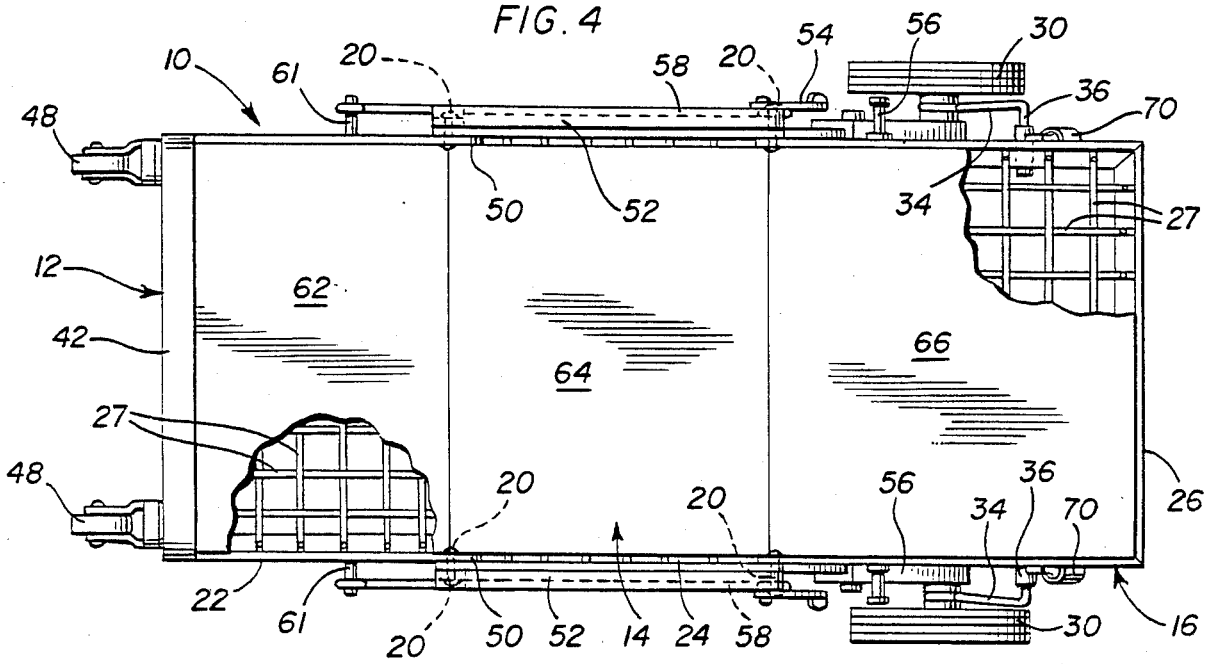
FIG. 4 is a plan view of the unit in the bed forming mode.

A convertible bed/wheelchair unit 10 in accordance with the invention is formed by three pivotally interconnected framework sections, namely a foot section 12, a central or seat section 14, and a back or head section 16, the sections being pivotally interconnected about transverse horizontal axes by suitable pivot pins or the like, generally indicated by references 20. The sections have respective rectangular planar framework portions 22, 24, 26, each with mattress support straps 27 or like mattress supports associated therewith in a known manner. The foot section 12 of the unit is pivotally connected at the front of framework portion 22, and the head section 16 is pivotally connected at the back of framework portion 22. In the bed forming mode of the unit, FIGS. 3–5, the framework portion 22, 24, 26 are juxtaposed to form a substantially continuous horizontal mattress support surface. The dimensions of the framework portions preferably are such that the support surface has an area conforming to that of a conventional single bed.

Central section 14 of the unit has a pair of telescopically adjusted legs 28 depending from the back end of framework portion 24, the upper ends of the legs being securely welded, riveted or otherwise attached to the framework portion, and the lower ends of the legs being provided with wheels 30 which may be interconnected by an axle or brace 32, and which may be provided with wheel locks of known form, not shown in the drawings. The pivotal head section 16 of the unit is supported in the bed forming made by a pair of rod-like braces 34 which, at their lower ends, are pivotally connected to the ends of axle 32, and the upper ends 33 of which are cranked and releasably received in tubular keepers 36 welded to the underside of framework portion 26. When the unit is converted from the bed forming mode into the wheelchair forming mode, the braces 34 can be moved to an inoperative position with their upper ends engaging in apertures 38 in the legs.

Figure 5:
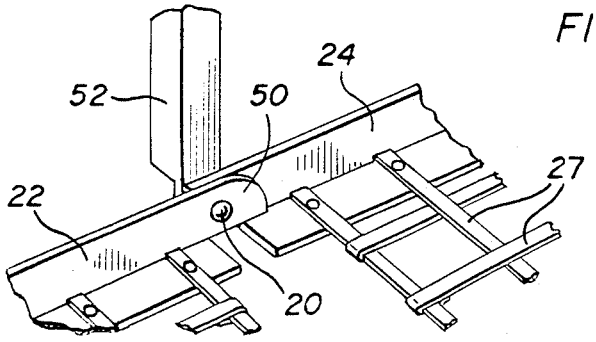
FIG. 5 is an enlarged perspective view of a detail of the unit.
Figure 6:
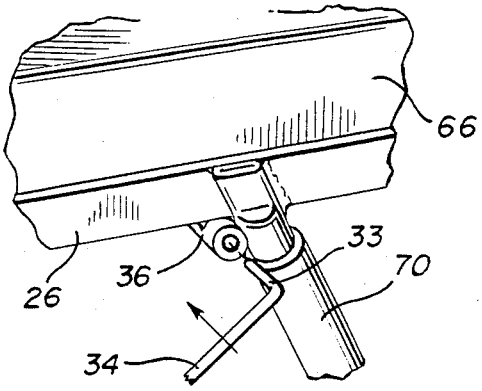
FIG. 6 is an enlarged perspective view of another detail.

Foot section 12 of the unit has a further pair of telescopically djustable legs 40 at the lower end of framework portion 22, the upper parts **40*a* of legs 40 being securely riveted, welded or otherwise attached to framework portion 22. The upper parts of the legs 40 may be formed as integral extensions of an arched frame element 42 forming a support for a footboard 44. The lower portions 40*b* of legs 40 are provided with casters 46 which may also be provided with caster locks, not shown. Framework portion 22 may be extended beyond the footboard 44 and be provided with additional casters 48, which could be removable. As shown in FIG. 5, the back end of framework portion 22 has extended ears 50 which, in the bed forming mode of the unit, engage framework portion 24 to prevent the bed from collapsing. Mounted at the front end of framework portion 24 are pivotal armrest members 52, the back ends of which have pivoted notched latch members 54 for engaging keepers 56 on framework portion 26 in the wheelchair forming mode. Additional bracing rods 58 are pivotally mounted at the back end of framework portion 24 for engaging pin-type keepers 60 at the front end of framework portion 22 in the wheelchair mode, for support of the unit, and which are stored on further pin-type keepers 61 on the framework portion 22 in the bed forming mode. The respective framework portions 22, 24, 26 have conforming mattress segments or cushions 62, 64, 66** which, for extra comfort, may be of a foam construction.

To convert the unit from the bed forming mode into the wheelchair forming mode, bracing rods 34 are released from keepers 36, allowing head section 16 of the unit to be pivoted upwardly. Armrest members 52 are swung upwardly and the latch members 54 engaged with keepers 56 in a notch selected to provide a required inclination of head section 16. Dependent on the notch selected, the inclination of the head section can be adjusted. Then, while the front end of central section 14 of the unit is suitably supported, the foot section is swung down from the position shown in FIGS. 3 and 4 to the position shown in FIGS. 1 and 2, so that legs 40 are brought to a position beneath section 14, and casters 48 are brought into ground engagement. The bracing rods 58 are then engaged with keepers 60, and to complete the conversion the cushions are adjusted lengthwise of the unit. Framework portion 26 is provided with handles 70 for manipulating the unit when in the wheelchair mode.

It will be seen that conversion from the bed mode to the wheelchair mode is extremely simple to effect, and it it understood that the above operations may be reversed to reconvert the unit from the wheelchair mode to the bed mode.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A convertible bed/wheelchair unit comprising a three-part pivotally interconnected frame including a first part constituting a foot section of the unit, a second part constituting a central or seat section of the unit, and a third part constituting a head section of the unit, the foot and head sections being pivotally interconnected about respective transverse axes to the seat section at front and back ends of the seat section, respectively, the seat section including first wheeled leg means depending therefrom toward the back end of the seat section, the head section being pivotally movable between a bed forming position of the unit wherein it forms a horizontal extension at the back of the seat section and a wheelchair forming position of the unit wherein it extends upwardly from the back end of the seat section, the unit including first releasable brace means for connection between the first wheeled leg means on the seat section and the head section for retaining the heat section in the bed forming position, and second releasable brace means for connection between the seat section and the head section for retaining the head section in the wheelchair forming position, the foot section being pivotally movable between the bed forming position of the unit wherein it forms a horizontal extension at the front of the seat section and the wheelchair forming position wherein the foot section extends downwardly from the front end of the seat section, wheel means depending from the lower back end of the foot section and engaging the ground when the unit is in the wheelchair forming position wherein the foot section forms a substantially vertically oriented support for the front end of the seat section and second wheeled leg means mounted on and depending from the front end of the foot section when in the bed forming position said second wheeled leg means extending beneath the seat section when the unit is in wheelchair forming position, and the unit further including third releasable brace means for supporting connection between the foot section and the seat section in both the wheelchair and bed forming positions of the unit.

2. The invention as defined in claim 1 wherein the first releasable brace means comprises first bracing rods for releasable connection between the first wheeled leg means and the head section in the bed forming position of the unit.

3. The invention as defined in claim 2 wherein the first bracing rods have lower ends pivotally attached to the lower ends of the respective first wheeled leg means and upper ends releasably connected in first keeper means on the head section in the bed forming position and in second keeper means on the upper end portions of the first wheeled leg means in the wheelchair forming position.

4. The invention as defined in claim 1 wherein the second releasable brace means comprises armrest-forming members connected to opposite sides of the seat portion and latch devices connected at respective back ends of the armrest-forming members for engagement with corresponding catch members on the head section when in the wheelchair forming position.

5. The invention as defined in claim 4 wherein the latch devices include means for selectively setting the inclination of the head section in the wheelchair forming position of the unit.

6. The invention as defined in claim 5 wherein each latch device comprises a pivoted latch with a series of spaced notches formed therein for selective engagement with the corresponding catch member.

7. The invention as defined in claim 1 wherein the third brace means comprises bracing rods for releasable connection between the lower end of the foot section and the back end of the seat section in the wheelchair forming position of the unit.

8. The invention as defined in claim 7 wherein the bracing rods forming the third brace means are pivotally attached at the back end of the seat section and releasably attachable to respective first and second connectors on the second wheeled leg means in the bed forming and wheelchair forming positions of the unit, respectively.

9. The invention as defined in claim 8 wherein each of the wheeled leg means includes telescopically adjustable legs.

10. The invention as defined in claim 8 wheren the foot section includes a footboard frame formed as an extension of the second wheeled leg means.

11. The invention as defined in claim 8 including wheelchair handles connected to the head section of the unit.

12. The invention as defined in claim 8 wherein the first wheeled leg means are provided with wheels and the second wheeled leg means are provided with smaller size casters.

* * * * *